US007383949B2

(12) United States Patent
Cuomo

(10) Patent No.: US 7,383,949 B2
(45) Date of Patent: Jun. 10, 2008

(54) CARRIER AND METHOD

(75) Inventor: Angelo V. Cuomo, Staten Island, NY (US)

(73) Assignee: E-Z Media Inc., NY, NY (US)

( * ) Notice: Subject to any disclaimer, the term of this patent is extended or adjusted under 35 U.S.C. 154(b) by 417 days.

(21) Appl. No.: 11/012,440

(22) Filed: Dec. 15, 2004

(65) Prior Publication Data

US 2005/0109639 A1 May 26, 2005

Related U.S. Application Data

(63) Continuation-in-part of application No. 10/939,264, filed on Sep. 10, 2004, and a continuation-in-part of application No. 10/737,612, filed on Dec. 16, 2003, now Pat. No. 7,267,224, and a continuation-in-part of application No. 10/662,265, filed on Sep. 15, 2003, now Pat. No. 7,243,785, and a continuation-in-part of application No. 10/215,938, filed on Aug. 9, 2002, now Pat. No. 7,185,758.

(51) Int. Cl.
*B65D 75/00* (2006.01)

(52) U.S. Cl. ..... 206/162; 206/175; 206/427

(58) Field of Classification Search ..... 206/144, 206/162, 175, 180, 183, 188, 190, 427, 549; 229/117

See application file for complete search history.

(56) References Cited

U.S. PATENT DOCUMENTS 2,026,525 A 1/1936 Korte
2,405,517 A 8/1946 Plummer
2,513,079 A * 6/1950 Buerger ..... 229/117
2,630,264 A * 3/1953 Holy ..... 206/198
2,850,223 A 9/1958 Strauss
2,991,908 A 7/1961 Conescu
3,158,286 A * 11/1964 Phillips, Jr. ..... 206/180
3,266,663 A 8/1966 Ringler
3,547,339 A 12/1970 Bruce
3,576,274 A 4/1971 Stramaglia
4,047,610 A 9/1977 Stout et al.
4,378,880 A * 4/1983 Summers ..... 206/170
4,610,349 A * 9/1986 Schwartz et al. ..... 206/175
4,767,051 A * 8/1988 Single ..... 229/117
4,836,367 A * 6/1989 Golkar ..... 206/200
5,695,051 A * 12/1997 Hart ..... 206/198
5,738,217 A 4/1998 Hunter
5,797,486 A 8/1998 Picciolo (Continued)

*Primary Examiner*—David T Fidei
(74) *Attorney, Agent, or Firm*—Kramer Levin Naftalis & Frankel LLP; Gregor N. Neff

(57) ABSTRACT

A carrier is provided with vertical support panels, each with a receptacle extending outwardly from its lower region. The carrier is made from blanks in which foldable panels are arranged in linear arrays. In the blanks, the vertical support panels can be folded and bonded to one another back-to-back. This facilitates close nesting of the blanks with one another on a sheet of fiberboard material so as to maximize the number of carriers which can be made from a given area of sheet material. Preferably, the vertical support panels and side panels are joined together serially along fold lines perpendicular to the longitudinal axis of the linear array, while flanges forming bottoms for the receptacles are joined to the vertical support panels and side wall panels along fold lines parallel to the longitudinal axis.

21 Claims, 8 Drawing Sheets

U.S. PATENT DOCUMENTS 5,803,264 A 9/1998 Gersten et al.
5,927,502 A 7/1999 Hunter
5,975,287 A 11/1999 Negelen
6,202,826 B1 3/2001 Shimada
6,341,689 B1 * 1/2002 Jones ..... 206/175
6,443,308 B1 7/2002 Davis
2003/0213705 A1 11/2003 Woog

* cited by examiner

FIG. 19.
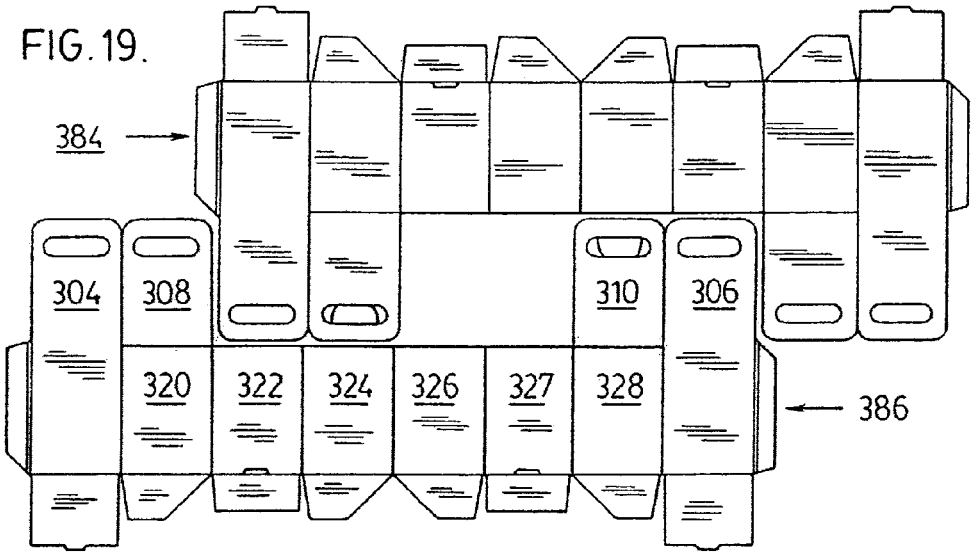
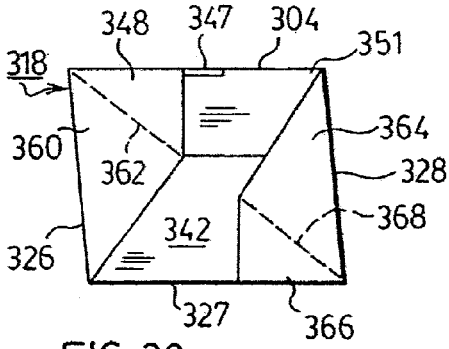
FIG. 20.
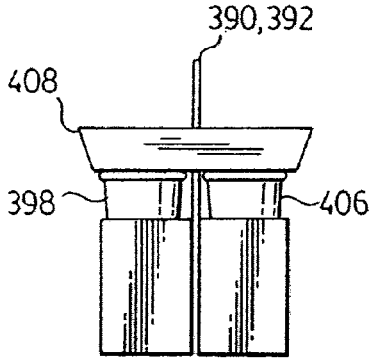
FIG. 21.
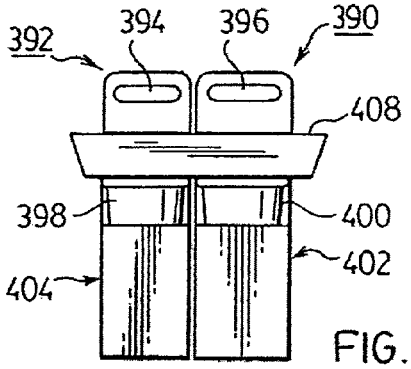
FIG. 22.

CARRIER AND METHOD

This patent application is a continuation-in-part of U.S. patent applications Ser. No. 10/215,938 filed Aug. 9, 2002 now U.S Pat. No. 7,185,758; Ser. No. 10/662,265, filed Sep. 15, 2003 now U.S. Pat. No. 7,243,785; Ser. No. 10/737,612 filed on Dec. 16, 2003 now U.S. Pat. No. 7,267,224; and Ser. No. 10/939,264 filed on Sep. 10, 2004.

This invention relates to carriers for beverages, food, liquids in containers and other objects, and to methods of making and using such carriers.

In the above-identified prior patent applications are disclosed a number of different general-purpose carriers, and other carriers which are highly advantageous for use in carrying beverages, e.g., in "six packs" of bottles containing soft drinks, beer, etc. Other carriers are specially adapted for use in carrying both beverage cups and solid foods in sports arenas, fast-food restaurants, etc. The disclosures of those carriers hereby is incorporated herein by reference.

Although those carriers are highly advantageous, improvements are desired in order to reduce their manufacturing costs.

Accordingly, it is an object of the invention to provide a carrier construction and blank, and a method of making such a carrier in which the manufacturing cost is significantly reduced.

It is another object of the invention to provide such a carrier which is relatively strong and capacious, and relatively easy to unfold.

It is another object to provide such a carrier that stands upright and open when being loaded, provides substantial areas on which advertising can be located, and can be used with relative safety and reliability to carry cumbersome objects with a minimum of spillage.

In accordance with the present invention, the foregoing objects are satisfied by providing a carrier with vertical support panels, each with a receptacle extending outwardly from its lower region. The carrier is made from blanks in which foldable panels are arranged in linear arrays. In the blanks, the vertical support panels can be folded and bonded to one another back-to-back.

This facilitates the relatively close nesting of blanks on a sheet of material and thus reduces the amount of sheet material occupied by each blank and aids in reducing manufacturing costs.

Preferably, the side wall panels and vertical support panels are foldable relative to one another along lines perpendicular to the longitudinal axis of the array, and shorter flanges forming the bottom structures of the receptacles are foldable along lines parallel to the longitudinal axes.

This facilitates both nesting and automatic folding to form finished, folded carriers.

It also is preferable that all of the fold lines parallel to the axes are located along one edge of the blank to facilitate folding by use of automatic folding equipment.

In one specific embodiment of the invention, there is provided a carrier blank comprising a sheet of material shaped to form a linear array of parts, said parts comprising, first and second vertical support panels, a first group of foldably interconnected side wall panels and foldable to form a side wall structure for a first receptacle to be secured to one of said vertical support panels, and a second group of foldably interconnected side wall panels foldable to form a side wall structure for a second receptacle to be secured to the other of said vertical support panels, and flanges extending from said side walls and said vertical support panels and being foldable to form bottom wall structures for said receptacles, said vertical support panels being foldable to be secured together back-to-back.

In other respects, the invention comprises the additional features of the various different carriers disclosed in the above-identified pending patent applications whose disclosures are incorporated by reference into this patent application.

The foregoing and other objects and advantages of the invention will be apparent from or set forth in the following description and drawings.

IN THE DRAWINGS

FIG. 19 is a top plan view of a pair of nested blanks of an alternative form used to make a carrier like the carrier of FIG. 17;

FIG. 20 is a bottom plan view of a portion of the carrier shown in FIG. 17, with the carrier partially collapsed;

FIG. 21 is a front elevation view of another embodiment of the invention; and FIG. 22 is a side elevation view of the embodiment shown in FIG. 21.

FOUR-COMPARTMENT CARRIER

FIGS. 1, 2, 6 and 8 show a general-purpose four-compartment carrier 20 with a locking bottom structure. The four compartments or receptacles can hold beverage cups, cans or bottles and a variety of other types of objects, such as potted plants, cans of motor oil or fuel additive, etc.

Figure 1:
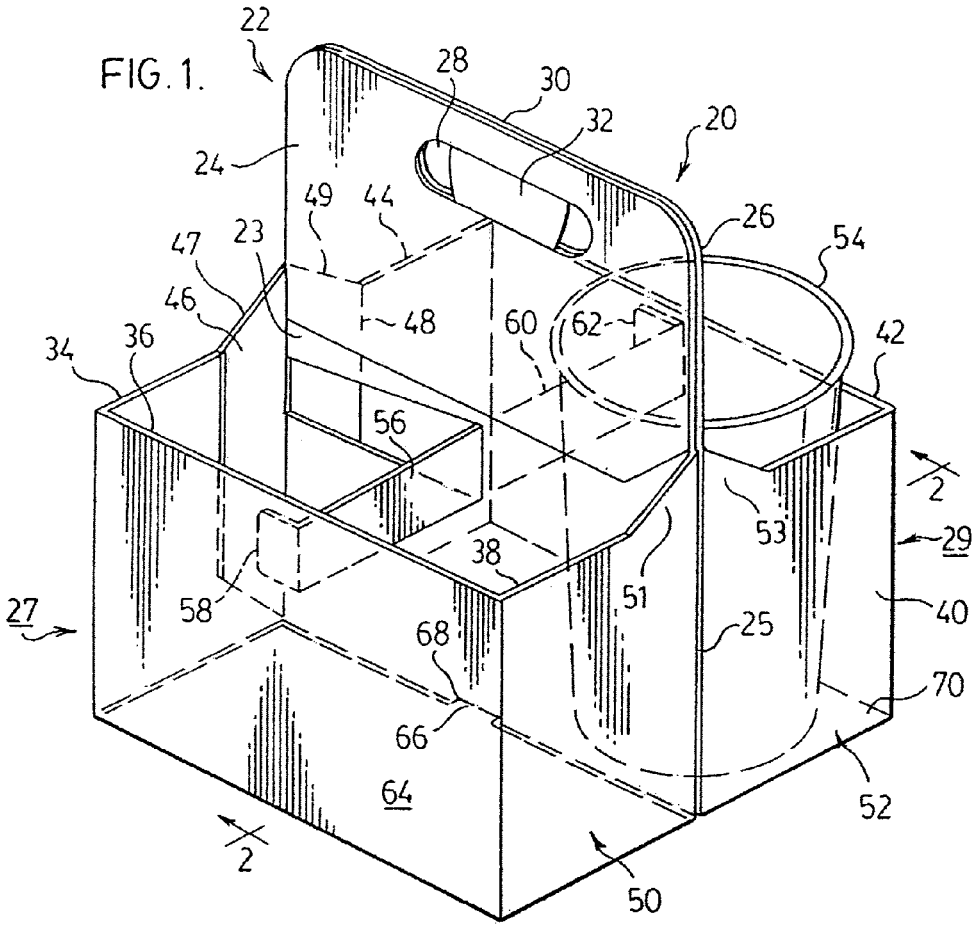
FIG. 1 is a perspective view of one embodiment of a carrier constructed in accordance with the present invention.
Figure 3:
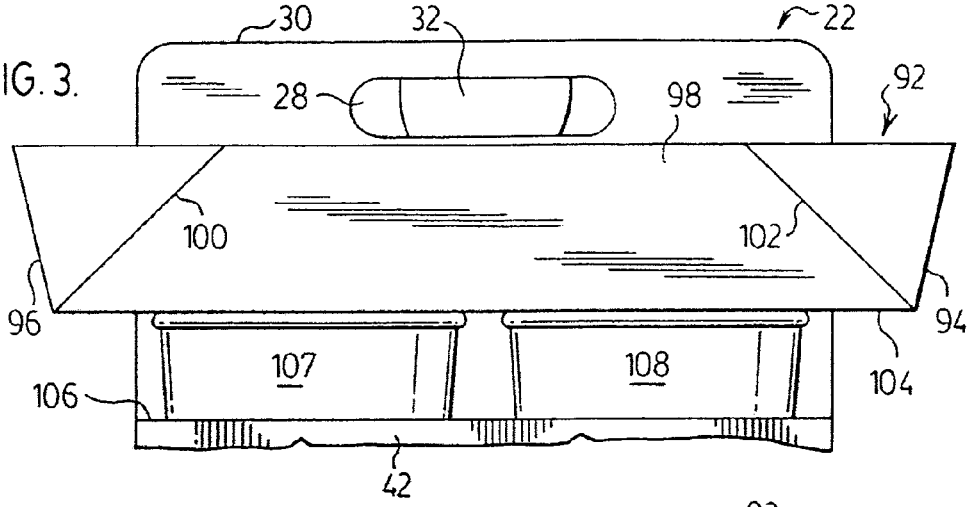
FIG. 3 is a side elevation view, also partially broken away, of the carrier of FIG. 1 with a food carrying tray mounted thereon.
Figure 4:
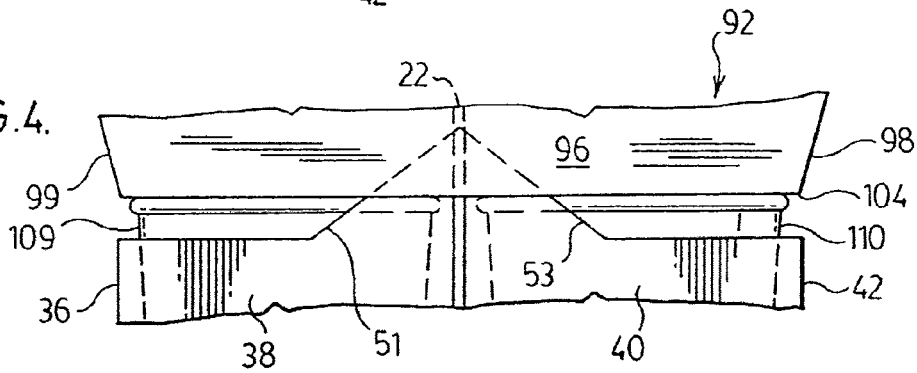
FIG. 4 is a front elevation view, also partially broken away, of a structure shown in FIG. 3.
Figure 5:
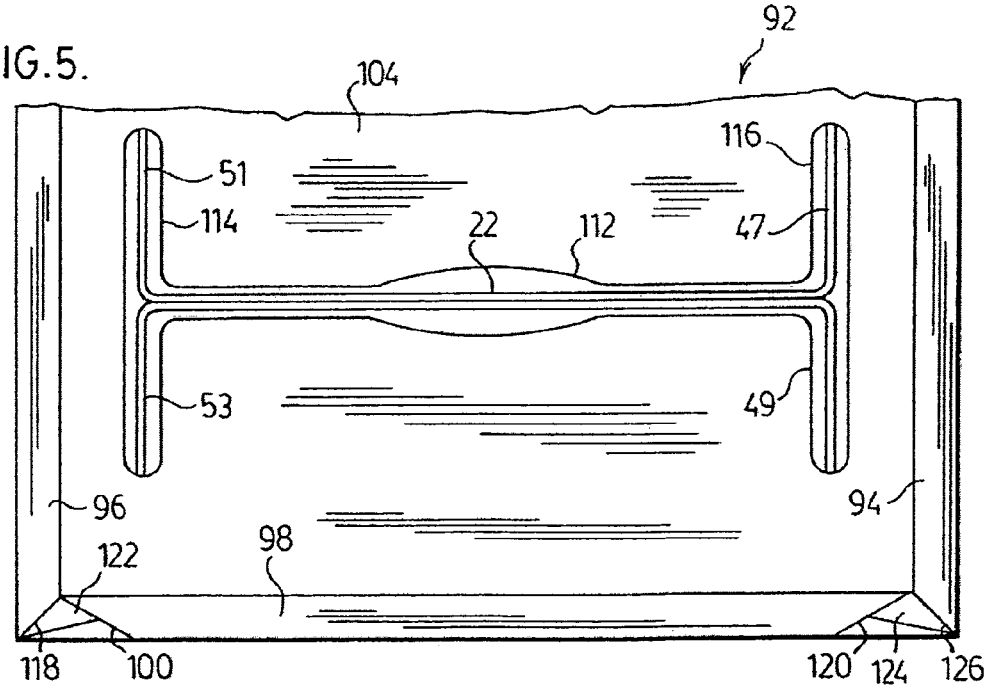
FIG. 5 is a top plan view, also partially broken away, of the structure shown in FIG. 3.

FIGS. 7-11 show a preferred method of manufacturing the carrier 20, as well as other carriers described herein, and FIGS. 3-5 show a top tray accessory for carrying food or other items above the items in the four compartments of the FIG. 1 carrier.

The carrier 20 includes a central support structure 22 including two vertical support panels 23 and 25 glued or otherwise bonded together. The central support structure 22 has an upper edge 30 and a hand-hole 28 below the upper edge 30, with a foldable hand guard 32.

The upper portion of the central support structure 22 has a front surface panel 24 and a rear surface panel 26, which are bonded, respectively, to the upper areas of the panels 23 and 25, thus forming a four-ply handle structure.

A receptacle structure extends outwardly from each of the two vertical support panels 23 and 25. One receptacle 27 includes a panel folded to form the side walls 34, 36, and 38 and secured at one end to the panel 23 by a flange 47 extending from the left edge of the panel 23 and bonded to the panel 34.

Similarly, a second receptacle 29 on the opposite side of the carrier is formed by side walls 40, 43 and 44, with a flange 48 extending from the left edge of panel 25 bonded to the panel 44.

Each of the two receptacles has a bottom structure 50 or 52 including a hinged locking panel 64 which extends completely across the bottom structure (see FIG. 2) and has a locking tab 66 or 72 extending from its outermost edge. The tabs 66 and 72 fit into slots 68 or 74 at the bottom of the vertical support panel 23 or 25, as it is shown in greater detail in FIG. 2.

Figure 2:
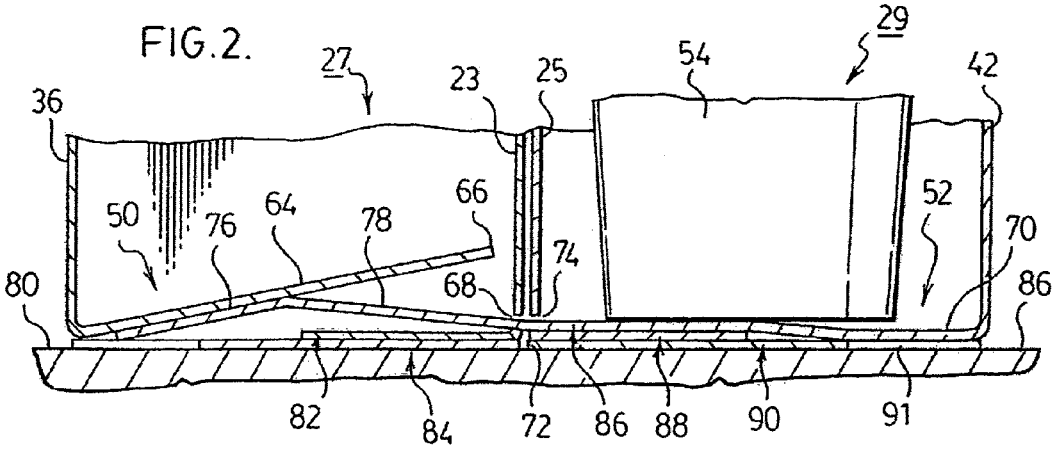
FIG. 2 is a cross-sectional, partially broken-away view taken along line 2-2 of FIG. 1.
Figure 6:
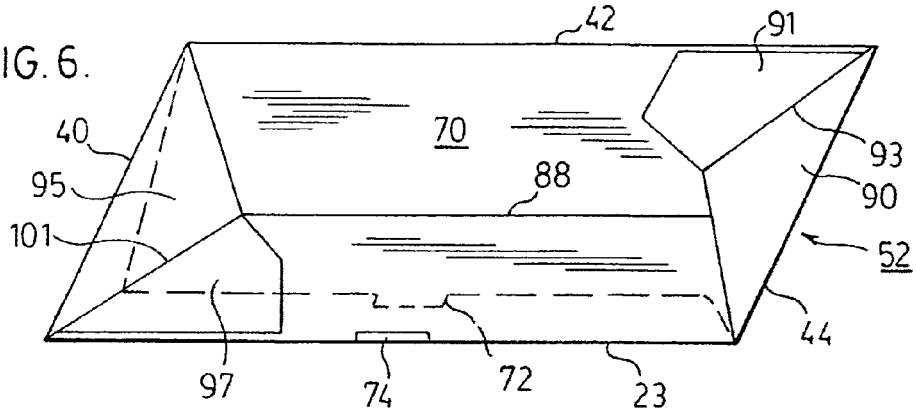
FIG. 6 is a bottom plan view of a portion of the carrier shown in FIGS. 1-5 in a partially collapsed condition.

Now referring to FIG. 2, as well as to FIG. 6, each of the receptacles has a bottom support structure like most of the embodiments of the invention described in the above-identified pending patent applications, and other embodiments described herein.

FIG. 2 is a broken away cross-sectional view taken along line 2-2 of FIG. 1. The carrier shown in FIG. 1 is standing erect on a horizontal surface such as the surface 80 shown in FIG. 2. The carrier 20, which is folded and flattened when shipped, is shown in FIG. 1 after it has been unfolded by the simple operation to be described below.

Referring to FIG. 2, the bottom structure 50 of the left-hand receptacle 27 shown in FIG. 2 is in the position it normally takes immediately after the carrier has been unfolded and before any beverage containers or other objects have been placed in the receptacle, or before someone has pushed the panel 64 downwardly to insert the locking tab 66 into the slot 68.

The right-hand receptacle 29 is shown in FIG. 2 with a full beverage cup 54 in place. The full cup has pressed down upon the panel 70 and pressed the locking tab 72 into the slot 74.

The locking or top panels 64 and 70 are rectangular and are almost as long as the distance between side walls 34 and 38. The rectangular shape of the panels 64 and 70 thus advantageously holds the receptacles 27 and 29 open so that the carrier 20 will sit erect on a horizontal surface with the receptacles 27 and 29 open so that the carrier easily can be filled with beverage cups or other objects.

As it will become apparent from the discussion below, as the carrier 22 is opened, the bottom panels 64 and 70 are automatically pulled downwardly approximately to an angle such as that shown for the panel 64 in FIG. 2 by the interlocking bottom structure to be described below.

Referring to FIG. 6 of the drawings, the bottom structure 52 includes the broad locking panel 70 with its tab 72 which is hinged at the bottom of the side wall panel 42. Also, a panel 88 which extends approximately half way across the width of the receptacle 29 is hinged from the bottom edge of the vertical support panel 23.

A first corner structure includes a flange hinged to the bottom edge of the side panel 44 and consisting of a first portion 90 and a second portion 91, separated from one another by a fold line 93.

A second corner structure is located at the corner of the bottom structure which is opposite to the first corner structure. The second corner structure, which is hinged from the lower edge of the side wall panel 40, consists of a first portion 95 and a second portion 97 joined to the first portion 95 at a fold line 101.

The flange portion 91 is bonded to the top panel 70, and the flange portion 97 is bonded to the panel 88.

As the carrier is unfolded, the two corner flange structures pull downwardly on the panels 70 and 88 until they reach a position spaced somewhat upwardly from the bottom of the receptacle. Then, top panel 70 is pressed downwardly by hand or by the weight of an object being placed upon it to snap the lock tab into the slot to hold the bottom structure flat.

The corner structures and the overlapping long panels together form a very strong multi-ply bottom structure capable of holding substantial loads.

A first divider 56 with an end tab 58 adhered to the inner surface of the wall 36 divides the left-hand receptacle 27 into two compartments. Similarly, a second divider 62 with an end tab 62 bonded to the side wall 42 provides a divider for the right-hand receptacle 29.

In addition, gussets 51, 53, 47 and 49 are provided at the junctions between the side walls 38, 40, 34 and 44 and the vertical panel structure. These gussets, as well as the dividers, are optional. The gussets provide added strength for the carrier structure, if needed.

Auxiliary Tray

FIGS. 3-5 show an auxiliary tray 92 designed for use with the carrier 20. The tray is substantially the same as the trays shown in the above-identified patent applications;

The tray 92 has a bottom wall 104, and four upstanding side walls 94, 96, 98, and 99. The side walls 94 and 96 have triangular tabs 122 and 134, respectively, which are glued to the front and rear walls at the corners of the tray. The side walls are folded onto one another along fold lines such as lines 118 and 126 at the corners, and fold lines 100 and 120 so as to fold the tray flat for shipment and storage.

As it is shown in FIG. 5, the bottom wall 104 has an elongated slot 112 which is wider in the middle than at either end, and two end sections 114 and 116 which are perpendicular to the section 112. Thus, an "I"-shaped slot is formed in the bottom wall 104.

FIG. 4 is a broken-away side elevation view showing two beverage cups 107 and 108 in the carrier 20 and the tray 90 resting on top of the cups. It can be seen in FIGS. 4 and 5 that the gussets 47, 49, 51, and 53 extend upwardly through portions of the slots 114 and 116, while the central support structure 22 of the carrier extends upwardly through the slot 112.

If the gussets are not needed, then the slot can be simplified to be a single slot without end sections 114 and 116.

FIGS. 3 and 4 also show that the height of the beverage cups or other containers which might be present in the carrier 20 vary to a substantial degree. Thus, the tops of the cups 107 and 109 shown in FIG. 3 extend higher above the upper edge 106 of the side wall 42 of the carrier than do the tops of the cups 109 and 110 in FIG. 4. However, it is preferred that the tops of the beverage containers always be above the upper edge of the side walls of the carrier so that the containers are easily accessible to grasp them and remove them from the containers, and to minimize the amount of sheet material used in the carrier.

Manufacturing Method

Figure 7:
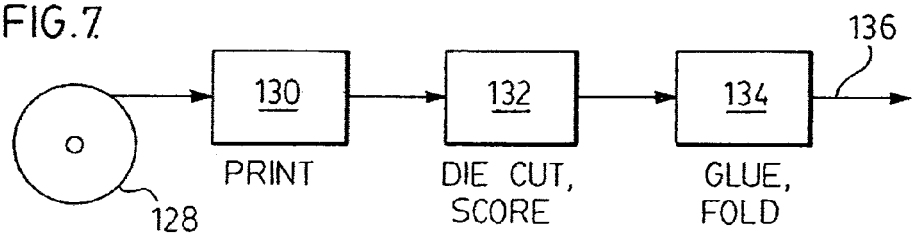
FIG. 7 is a schematic diagram illustrating the steps in a typical manufacturing process used to manufacture the carriers shown in FIGS. 1-6 and elsewhere herein.

FIG. 7 is a schematic diagram showing steps typically taken in manufacturing carriers in accordance with the present invention.

Figure 8:
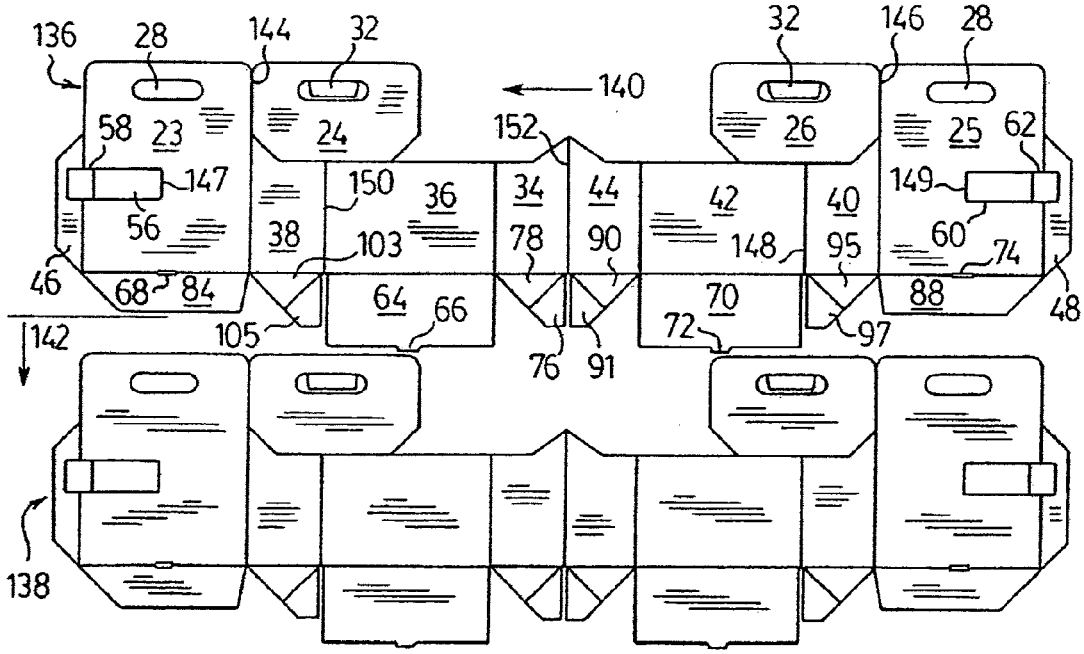
FIG. 8 is a top plan view of a pair of nested blanks used for making the carrier of FIGS. 1-6.

FIG. 8 shows two blanks 136 and 138 which are to be folded and glued to form two finished carriers.

Referring first to FIG. 7, fiberboard material usually from a roll 128 is fed first to a printing station 130 where legends, logos, advertising material, etc., are printed on the areas of a wide sheet of fiberboard material in positions in which the carriers will be formed. Typically, the sheet material can be relatively wide, e.g., 50 inches or more, depending upon the capacity of the die cutting, folding and printing equipment used.

The printed sheet material next moves to a die cutting and scoring machine 132 which die cuts and scores the material to form blanks such as the blanks 136 and 138.

As it will be explained in greater detail below, because of the linear array of panels formed by the panels making up the blanks, several blanks can be "nested" side-by-side across the width of the sheet material so as to maximize the usage of material and help minimize the manufacturing cost of the carrier.

FIG. 8 shows two of the blanks 136 and 138 nested side-by-side with one another. In actuality, three or more such blanks can be nested side-by-side, but the other blanks are not shown in order to save space in the drawings.

At the station 132, the sheet material is die-cut and scored to form fold lines.

Finally, each blank is automatically glued and folded to form a fully folded carrier, ready for packing and shipment, as it will be described in greater detail below.

Four-Compartment Blank Structure

Referring now to FIG. 8, part numbers have been shown on only one of the blanks, the blank 136, in order to avoid unnecessary duplication and crowding of the drawing.

The blanks 136, 138, etc., form a linear array of panels extending in the direction indicated by the arrow 140 which is parallel to the longitudinal axis of the array.

In general, the vertical support panels and side wall panels are joined together in series along fold lines perpendicular to the longitudinal axis of the array, and the panels and flanges forming the bottom structures of the receptacles are joined to the vertical support panels and side wall panels along fold lines which are parallel to the axis.

As it can be seen, the panels 23 and 24 are separate from one another except that they are joined along a fold line 144. Similarly, panels 25 and 26 are separate but attached along the fold line 146.

The divider arms 56 and 60 are formed as cutouts from the material of panels 23 and 25, respectively, with hinges at fold lines 147 and 149.

All of the flaps or flanges forming the bottom structures for the two receptacles 27 and 29 are located along one edge of the linear array. This has the advantage of enabling automatic folding equipment for the bottoms to be located along only one edge of the blank as the flaps and flanges are folded. This can reduce equipment required and/or can speed the manufacturing process.

FOLDING AND GLUING

Figure 9:
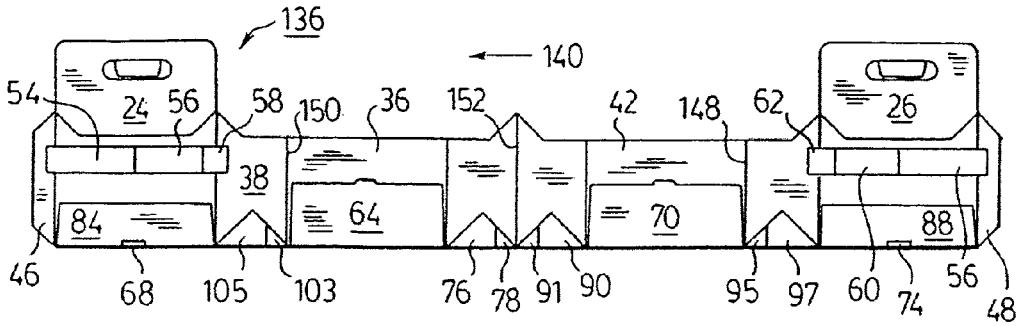
FIGS. 9-11 are views of one of the blanks shown in FIG. 8 at various stages of the process of manufacturing the carrier.
Figure 10:
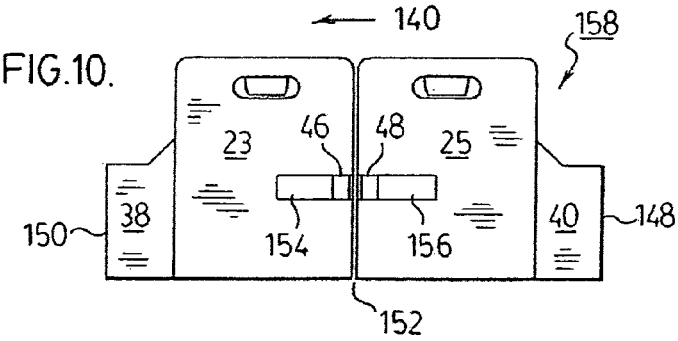
Figure 11:
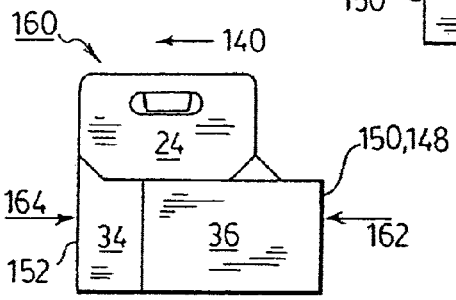

FIGS. 9-11 illustrate the folding and gluing processes at various stages of completion.

First, as it is shown in FIG. 9, adhesive is applied to the upper surfaces of the panels 24 and 26, and the panel 24 is folded onto the panel 23 along line 144 and pressed to adhere it to the panel 23. Similarly, panel 26 is folded along line 146 onto the upper portion of panel 25 and adhered in place.

Also, each of the divider arms 56 and 60 is folded out from its original position, thus leaving an opening 154 or 156 in the panel 23 or 25.

Each of the panels 84, 64, 70 and 88 is folded upwardly to the position shown in FIG. 9.

Each of the corner flaps is folded twice, first along its lower edge, and then the flaps 105, 76, 91, and 95 are folded downwardly along the diagonal fold line of each of the corner structures.

Then, each of the end flanges 46 and 48 is folded over, the flange 46 to the right, and the flange 48 to the left.

Next, adhesive is applied to each of the flanges 46 and 48, 58, 105, 76, 91, 95, and 62.

Referring now to FIG. 10, next, the blank is folded along fold lines 150 and 148 shown in FIG. 9 to the shape shown in FIG. 10, and the folded-over portions are pressed onto the portions below them so that the adhesive on the adhesive-coated surfaces adheres to each of the surfaces it touches. Thus, the pad 76 adheres to the flap 84, the pad 105 adheres to the flap 64, and the pad 58 adheres to the middle of the panel 36.

Referring now to FIG. 11, next, adhesive is applied to the surfaces 23 and 25 shown in FIG. 10, and the blank is folded along the center line 152 and the halves are pressed together in order to bond the two vertical support panels 23 and 25 together back-to-back, thus forming the partially-folded carrier blank 158.

The use of linear arrays of panels to form the carrier structure is highly advantageous not only in that it allows for closer and more efficient nesting of the blanks, and produces corresponding material savings, but also in that more carriers can be produced per linear foot of sheet material, thus increasing production for a given speed of sheet material movement. This, of course, can further reduce manufacturing costs.

The finished folded carrier 160 shown in FIG. 11 is ready for packing and shipment to customers. The folded carrier 160 is advantageous in that it has a relatively small volume and thus provides savings in shipping containers and freight costs.

Unfolding The Carrier

When the folded carrier 160 it is removed from the carton to be used by the customer, the customer merely places one hand against the edge 152 and another against the edges 150, 148 of the blank and presses his or her hands together, applying pressure in the directions 162 and 164, and the folded-up carrier pops open to the position shown in FIG. 1.

The top tray 92 similarly can be folded and shipped to the customer, and can be unfolded quickly and easily for ready use.

Alternative Tray Structure

Figure 12:
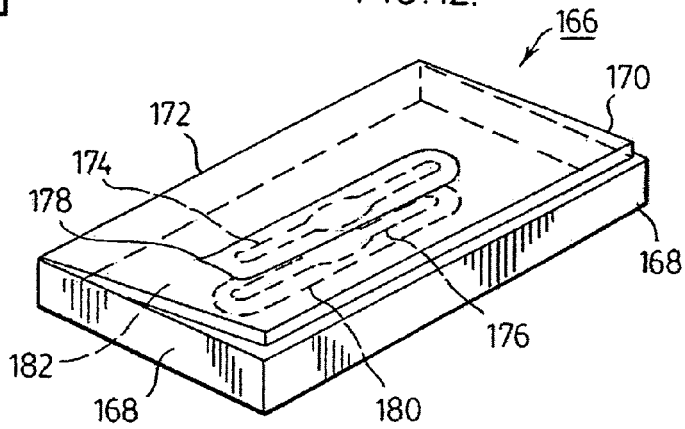
FIG. 12 is a perspective view of an alternative food-carrying tray which can be used instead of the tray shown in FIGS. 3-5.

FIG. 12 shows an alternative tray structure for mounting on the handle structure of the carrier shown in FIGS. 1-11.

The tray structure 166 comprises a closable box having side walls 168, a bottom wall 188, and a top wall 170 which is hinged at one edge 172 to the side wall 168

The box has a pair of slots 174 and 176, one in the top wall 170, and one in the bottom wall 182. Each slot is sized and shaped to received the vertical support structure 22 of the carrier 20 shown in FIG. 1. Each slot is covered by an adhesive strip 178 or 180 to protect the food inside the box until it is sold.

When the food is sold, the strips 178 and 180 are peeled off of the box, the vertical support panel 22 is inserted through the slots, and the food can be carried away with one hand, together with beverages in the carrier.

As it is disclosed in the above-identified patent application Ser. No. 10/939,264, such covered boxes can be used to carry hot or cold pizza pies, donuts, and other such items. The adhesive slot covers protect the food during storing, shipping, heating and handling prior to being used to deliver food to customers.

The box 166 is loaded with food at a processing location and is sent to remote distribution points, under refrigeration, if necessary. At the distribution points, the box can be heated to heat the food, if desired, the strips removed, the box placed on the carrier and carried away.

If an I-shaped slot in the box top and bottom like that shown in FIGS. 3-5 is needed, the adhesive strips would be shaped and sized to cover the entirety of each slot.

PACKAGED BEVERAGE CARRIER

Figure 13:
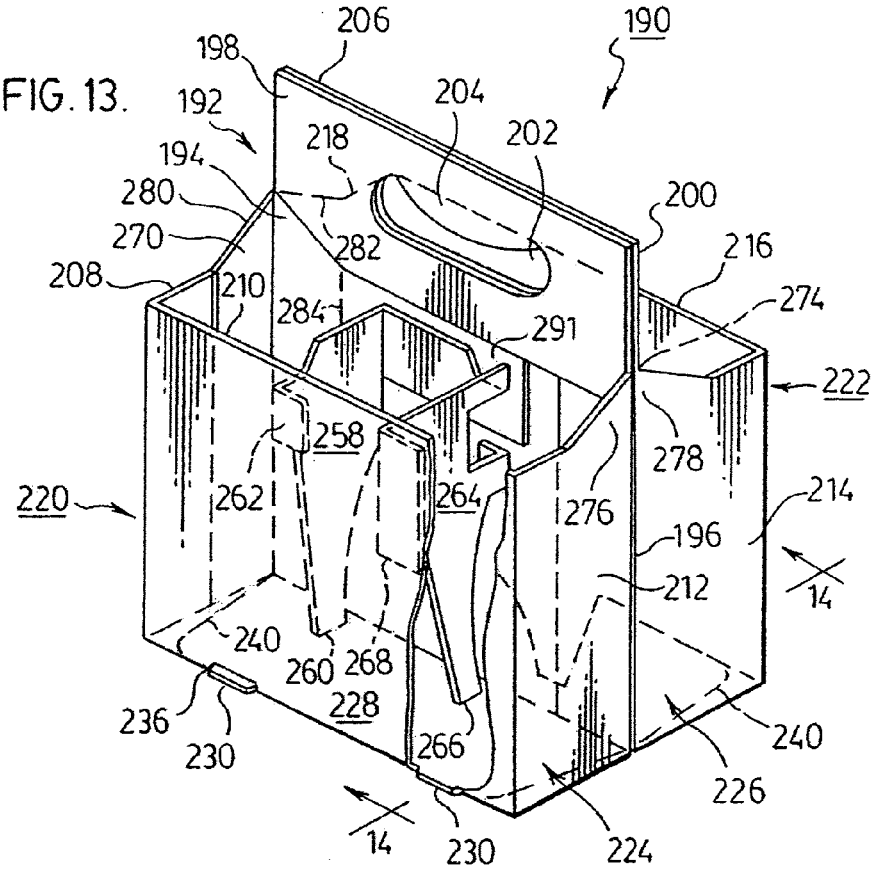
FIG. 13 is a perspective view, partially broke away, of a 6-pack carrier constructed in accordance with the present invention.
Figure 14:
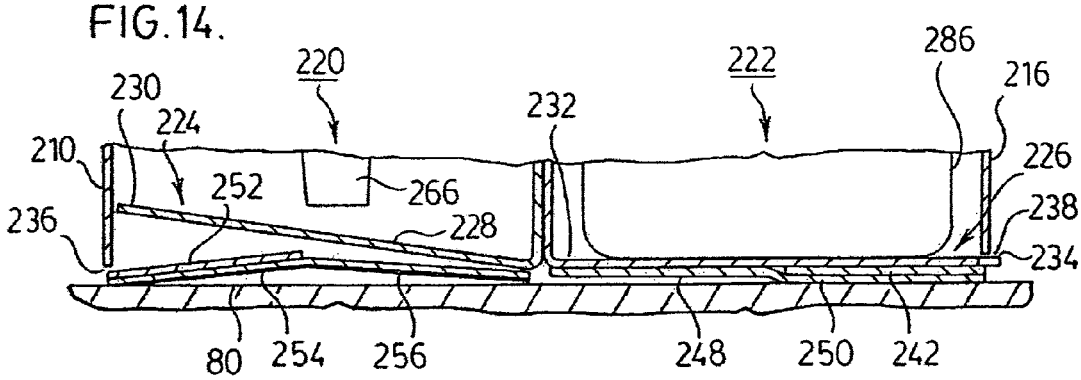
FIG. 14 is a cross-sectional, partially schematic view taken along line 14-14 of FIG. 13.
Figure 15:
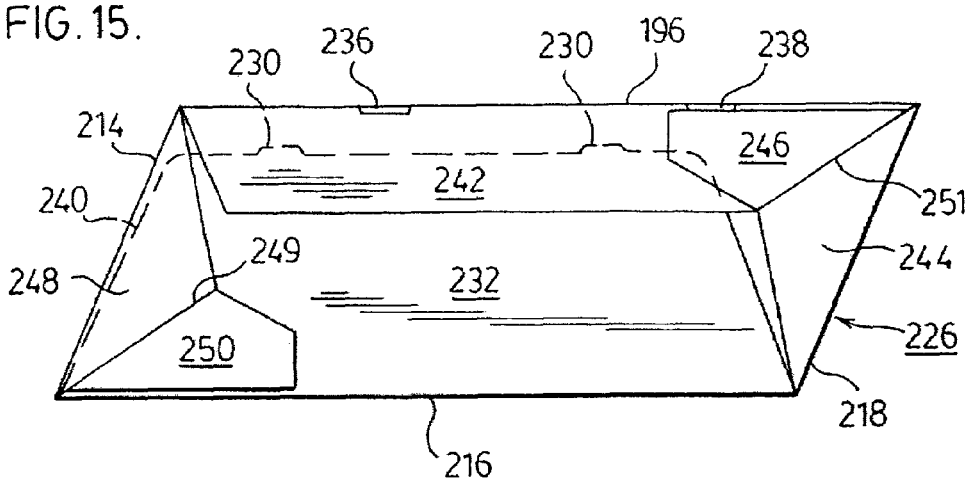
FIG. 15 is a bottom plan view of a portion of the carrier shown in FIG. 13, with the portion partially collapsed.

FIGS. 13, 14, and 15 show a "packaged" beverage carrier 190 constructed in accordance with the invention. In this embodiment, the carrier 190 is a six-pack carrier designed to hold six bottles of a soft drink, beer, water, or other beverage. It is of basically the same construction as the carrier 22 and others shown in the above-identified pending patent applications, but is specifically constructed so as to be easily filled by automatic filling equipment instead of by hand. The filled carriers then are shipped to stores.

The carrier 190 shown in FIG. 13 differs from that shown in FIGS. 1-12 also in that the carrier 190 is not as tall because there is no need for an auxiliary tray attachment, and because the carrier 190 is designed to have the same height as existing carriers which it is intended to replace.

The carrier 190 includes a vertical support structure 192 with panels 194 and 196 bonded together back-to-back, and with a front panel 198 and a rear panel 200, a hand-hole 202 and a foldable hand guard 204. The upper edge of the vertical support structure is shown at 206.

Two receptacles 220 and 222 are provided, one extending from panel 194, and the other from the panel 196. The first receptacle 220 includes side walls 208, 210, and 212, and the second receptacle 222 has side walls 214, 216, and 218.

The side walls are secured to the vertical support structure by means of flanges 270 and 284 extending from the panels 194 and 196.

Two dividers 258 and 264 in each receptacle extend from the central support structure and are bonded to the side wall 210 by means of tabs 262 and 268. Each of the dividers has a downwardly-extending tapered lower portion 260 or 266 extending to near the bottom of the carrier in order to provide cushioning between adjacent bottles in the three compartments formed by the dividers to reduce the possibility of breakage of the bottles.

Referring now to FIG. 14, as well as FIG. 13, each of the two receptacles 220, 222 has a bottom structure 224 or 226 which is similar to one of the bottom structures shown in FIGS. 1 and 2, with one of the main differences being that the top panel 228 is hinged to the vertical support structure instead of to the side wall opposite the vertical support structure. Also, the top panel 228 or 232 of the bottom structure is tapered at its side edges 240.

The tapered edges 240 are provided to minimize interference between the parts of the bottom structure when the carrier is unfolded. Although this reduces the tendency of the top panel to hold the carrier open during filling, this is not very significant in that the carriers usually are filled automatically by filling machines which hold the carriers open during filling.

Each of the top panels 228 or 232 extends across the bottom structure and has a pair of tabs 230 or 234, each of which extends outwardly and projects through one of a pair of slots 236, 238 in the wall panels 210 and 216 of the carriers to lock the top panels in place.

The bottom structures 224 and 226 are quite similar in principle to the bottom structure of the receptacles in the carrier 220 shown in FIGS. 1 and 2.

Thus, when a folded carrier is erected by pushing on opposed sides, the panel 228 or 232 is not depressed all the way down, but remains partially raised, similar to the bottom panel 68 shown in FIG. 2.

Then, when a full beverage bottle is placed in one of the receptacles 220 or 222, the weight of the beverage and bottle presses the top panels downwardly so that the tabs 230 bend and then snap into the slots 236 and 238 so as to lock the top panel of the bottom structure in place. This construction, in combination with the remaining panels which support it, provides an exceptionally strong bottom which locks automatically, without the need of a separately-actuated latching structure such as that needed in manufacturing some prior carriers.

FIG. 15 shows a partially-collapsed bottom structure 226 for the receptacle 222 of the carrier 190 shown in FIG. 13. Two corner structures are provided. One has a flange 248 extending from the bottom edge of the side wall 214, with a tab 250 connected along the fold line 249 to the flange 248. The tab 250 is bonded to the broad top panel 232 of the bottom structure 226.

In a corner opposite the corner in which the first corner flange structure is located is a second flange structure including a flange 244 extending from the bottom edge of the side wall 218, with a tab 246 connected to the flange 244 along a fold line 251. The tab 246 is bonded to the flange 242 which extends from the bottom edge of the vertical support panel 196.

The corner flange structures operate in substantially the same way as the corresponding structures shown in FIGS. 1 and 6 to pull the bottom panels downwardly from a folded-up position so as to unfold the receptacle structures.

Packaged Beverage Carrier Blank

Figure 16:
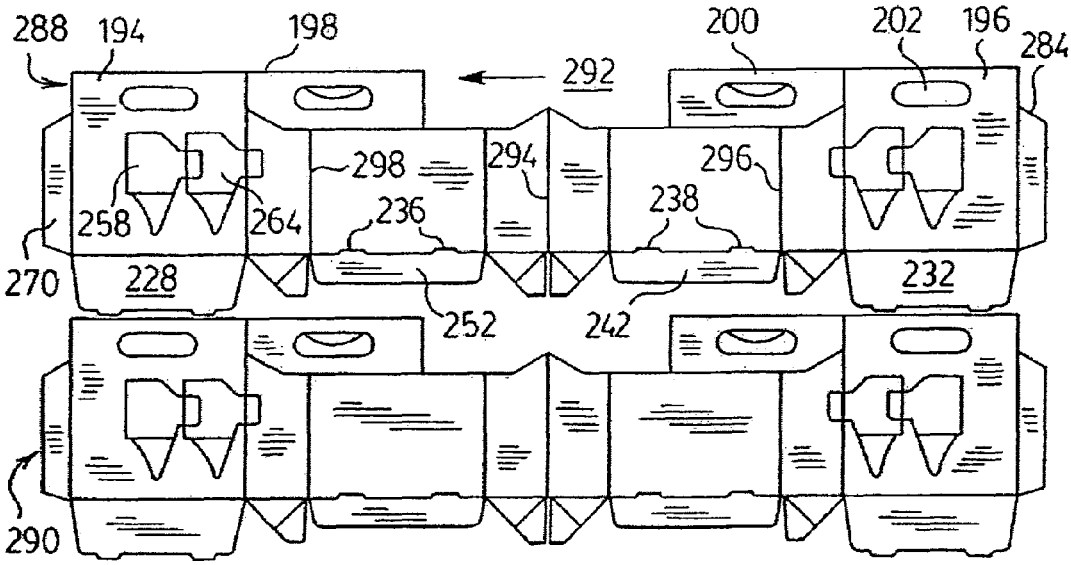
FIG. 16 is a top plan view of a pair of nested blanks used to make the carrier shown in FIGS. 13-15.

FIG. 16 shows two linear arrays 288 and 290, each forming a blank to make a single carrier of the type shown in FIGS. 13-15.

Only two linear blanks 288 and 290 are shown in FIG. 16. They are nested together closely to maximize use of the sheet material. However, in a typical installation, up to four or more blanks can be nested across the sheet, thus illustrating the material savings provided by the invention.

The process of making the carrier 190 is substantially the same as that illustrated in FIGS. 7-11 above. The sheet material first is printed, then sent to a die cutting and scoring station, where the sheet is cut and scored to form the shapes and fold lines indicated in FIG. 16.

The various portions of the blanks shown in FIG. 16 then are folded and glued substantially as described above, except that there are two dividers such as the dividers 258 and 264 in each of the receptacles instead of only one.

After the panels 198 and 200 are glued onto the panels 194 and 196, respectively, the bottom flanges are folded and glued, as are the end flanges 270 and 284, and the blank is folded along lines 298 and 296, and finally along central line 294 to complete a folded carrier, ready for use.

The carrier 190, when folded, has substantially the shape shown in FIG. 11 of the drawings, but is somewhat smaller. The folded carrier occupies substantially less area than the typical prior art "sling-bottom" carrier it is intended to replace, thus providing savings in shipping cartons and freight costs when the carriers are shipped to the bottling plants in which they are used.

As with the embodiments shown in FIGS. 1-11, the manufacturing process is believed to be faster, as well as more economical in the use of materials. This is believed to produce significant cost savings in manufacturing the product.

Two-Compartment Carrier

Figure 17:
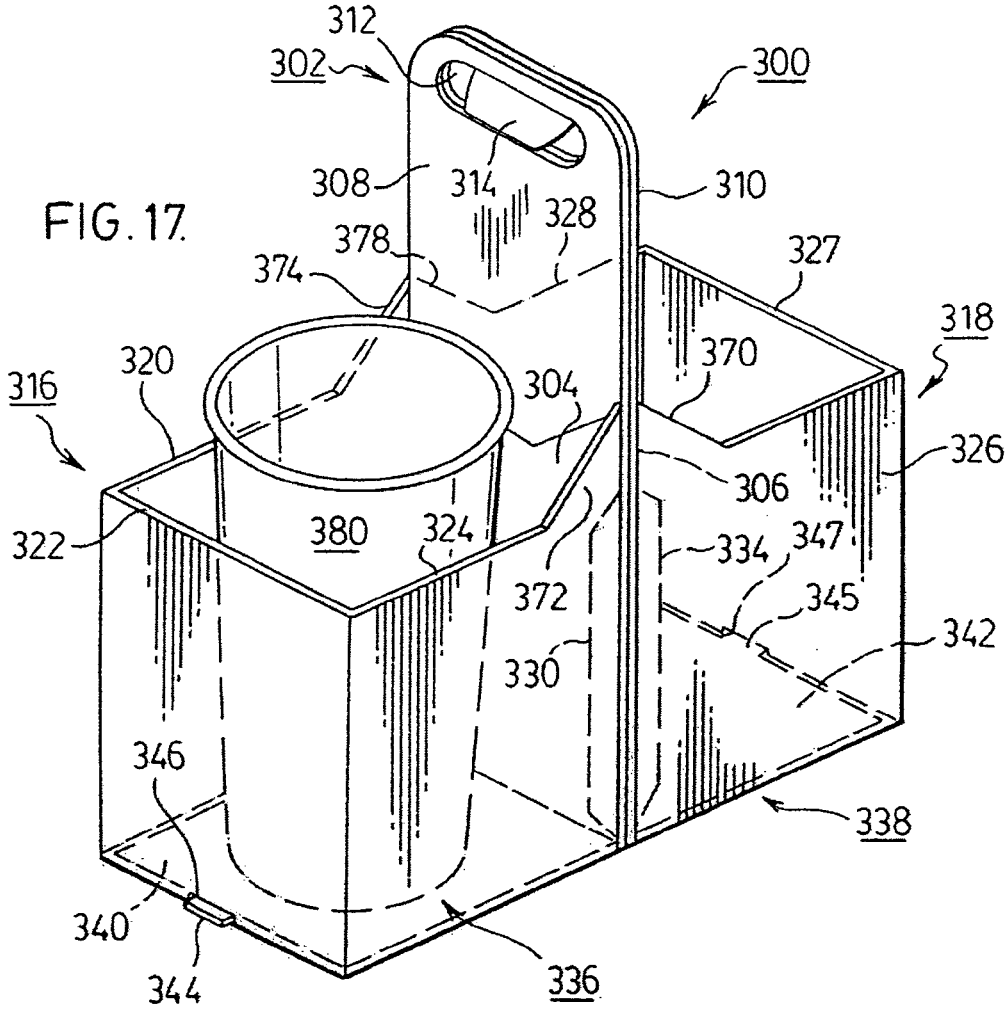
FIG. 17 is a perspective view of another carrier constructed in accordance with the present invention, this carrier being adapted to have two carrying compartments instead of the four compartments of the carrier shown in FIG. 1.

FIG. 17 is a perspective view of a two-compartment version 300 of the four-compartment carrier shown in FIGS. 1-11. The carrier 300 is essentially the same in construction as the embodiment shown in FIGS. 1-11, except it is only half as wide as the other carrier, and has only two receptacles instead of four.

The carrier 300 has a vertical support structure 302 with vertical support panels 304 and 306, and panels 308 and 310 bonded to the upper surfaces of the vertical support panels. The vertical support panels 304 and 306 are bonded together back-to-back.

A hand hole 312 and hand guard 314 are provided.

Two receptacles are provided at 316 and 318. The first receptacle includes side walls 320, 322 and 324, and the second receptacle includes side walls 326, 327 and 328. The side wall structures are secured to the central support structure 308 by means of flanges 330 and 334 which are bonded to the inside surfaces of the side wall panels 324 and 326, respectively.

Two bottom structures 336 and 338 are provided. Each has a top panel 340 or 342 with a projecting tab 344 or 345 which extends through a slot 346 or 347 in side wall 322 or 327.

FIG. 20 is a bottom plan view of a partially folded receptacle 318 showing the top panel 342, the opposing panel 351 (also see FIG. 18), and corner structures.

In one corner structure, a flange 260 extends from the bottom of the side wall panel 326 and has a tab 348 joined with it along a fold line 362. The tab 348 is bonded to the flange 351.

An opposing corner structure includes a flange 364 extending from the bottom edge of the side wall panel 328 and a tab 366 joined with the flange 364 along a fold line 368. The tab 366 is bonded to the flange 342.

The foregoing bottom structure automatically pulls down the bottom panels of each of the receptacles, substantially as described above in connection with the four-compartment embodiment.

The bottom of each receptacle, when fully opened, is approximately square.

A beverage cup 380 is shown in place inside the receptacle 316 in FIG. 17.

Ganged Carriers

FIGS. 21 and 22 are, respectively, a side elevation view and a front elevation view of a modification of the invention shown in FIGS. 17-20 in which a single tray which is wide enough to receive the handles of two separate two-cup carriers 390 and 392 is provided so that two of the two-compartment carriers can be ganged together and carried with one hand by means of the handle holes 394 and 396. The tray is shown atop three beverage cups 398, 400, and 406. The lower portion of each of the two separate carriers is shown at 402 and 404.

If preferred, a single shorter tray can be used with only one of the carriers shown in FIG. 17. Alternatively, a wider tray can be used which fits onto both of the four-compartment carrier and the two-compartment carrier.

Two-Compartment Carrier Blank

Figure 18:
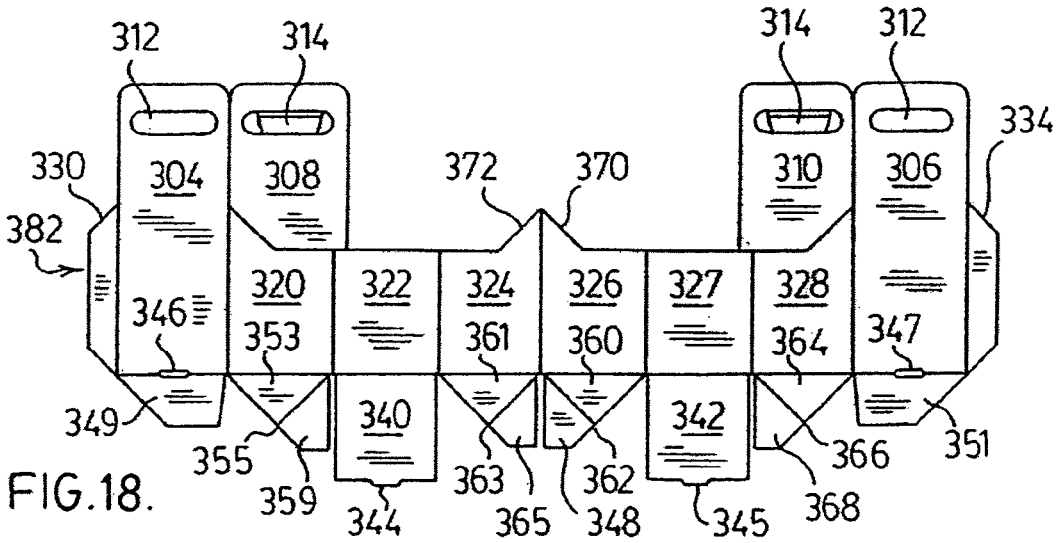
FIG. 18 is a blank used to manufacture the carrier shown in FIG. 17.

FIG. 18 shows an array 382 of panels of a linear blank used to make the carrier shown in FIG. 17. The printing, die cutting and scoring, and folding and gluing steps are substantially the same as shown above for the four-cup carrier and the packaged beverage carrier, and will not be repeated here.

The blanks 382 are nested on a sheet of material substantially in the manner shown in FIG. 19; that is, with alternate blanks inverted relative to one another. In this manner, the usage of sheet material is minimized.

FIG. 19 shows a pair of modified blanks 384 and 386 which are the same as blank 382 shown in FIG. 18, except that the gussets 370 and 372 (as well as gussets 374 and 378) are omitted from the blanks 384 and 386. This allows the blanks to be nested even closer together, thus further reducing the usage of sheet material.

Materials

The materials of which the carrier of the present invention can be made need not be expensive. Ordinary, medium-weight fiberboard is believed to be sufficient for most purposes. For example, it can be 0.20 S.U.S. recycled newspaper material. If waterproofing beyond the acrylic coating provided on such board is necessary, a further waterproof coating can be applied on both the inside and outside surfaces.

It is within the realm of the invention also to make the carriers out of flexible plastic materials.

If desired, the carriers can be made of plastic materials that are easily washable so that the carriers can be reused.

Bonding

Bonding of parts to one another can be done by means other than adhesives. For example, plastic or plastic coated parts can be bonded together by ultrasonic or heat bonding. Staples or other mechanical fasteners also can be used.

It can be seen from the foregoing that the invention well satisfies the objectives set for above. The carrier construction which permits the blanks to be made in linear arrays permits better nesting of the blanks on a sheet of fiber board material, thus providing significant savings in the use of materials in the carriers.

Additionally, it is believed that the speed of the automatic manufacturing of the carriers can be increased, and the manufacturing cost correspondingly decreased. Additional savings in the complexity of some of the folding machinery needed also may be realized.

The above description of the invention is intended to be illustrative and not limiting. Various changes or modifications in the embodiments described may occur to those skilled in the art. These can be made without departing from the spirit or scope of the invention.

What is claimed is:

1. A carrier blank comprising a sheet of material shaped to form a linear array of parts, said parts comprising:

(a) first and second vertical support panels, (b) a first group of foldably interconnected side wall panels foldably secured to said first vertical support panel along a vertical fold line to form a side wall structure for a first receptacle to be secured to said first vertical support panel, (c) a second group of foldably interconnected side wall panels foldably secured to said second vertical support panel along a vertical fold line to form a side wall structure for a second receptacle to be secured to said second vertical support panel, and (d) flanges extending from said side wall panels and said vertical support panels and being foldable together to form bottom wall structures for said receptacles, (e) said vertical panels being foldable along vertical fold lines to be secured together back-to-back in which each of said groups includes three side wall panels, in which each of said side wall panels and said vertical support panels has a top edge and a bottom edge, and a flange extending from each of said bottom edges, said flanges being adapted to fit together when folded to form said bottom wall structure for each of said receptacles, in which the flanges extending from one of said side walls and one of said vertical support panels in each of said receptacles extends across said bottom wall structure, and two others of said flanges in each of said receptacles is a corner flange foldable along a diagonal line.

2. A carrier blank as in claim 1 in which linear array has a longitudinal axis and said vertical support panels and said side wall panels are connected together along fold lines perpendicular to said axis, and said flanges are connected to said vertical support panels and said side wall panels along fold lines parallel to said axis.

3. A carrier blank comprising a linear array of components formed in a sheet of material and including:

(a) a first vertical support panel having a leading edge and a trailing edge;

(b) first, second and third side wall panels foldably connected together in series, said first side wall panel being foldably connected to said leading edge of first vertical support panel;

(c) fourth, fifth and sixth side wall panels foldably connected together in series, said fourth side wall panel being foldably connected to said third side wall panel; and (d) a second vertical support panel having a leading edge and a trailing edge, said sixth side wall panel being foldably connected to said trailing edge of said second vertical support pane in which each of said groups includes three side wall panels, in which each of said side wall panels and said vertical support panels has a top edge and a bottom edge, and a flange extending from each of said bottom edges, said flanges being adapted to fit together when folded to form said bottom wall structure for each of said receptacles, in which the flanges extending from one of said side walls and one of said vertical support panels in each of said receptacles extends across said bottom wall structure, and two others of said flanges in each of said receptacles is a corner flange foldable along a diagonal line.

4. A blank as in claim 3 including a first foldable edge flange extending from said trailing edge of said first vertical support panel, and a second foldable edge flange extending outwardly from said leading edge of said second vertical support panel, each of said flanges being foldable along a line parallel to said leading and trailing edges.

5. A blank as in claim 3 in which each of said panels has a bottom edge and a top edge, in which each of said vertical support panels has a top edge which extends beyond the top edges of said side walls by a substantial distance, and including a pair of handle reinforcement panels, each foldably extending in a direction perpendicular to said leading and trailing edges of one of said vertical support panels to fold over upon the upper portion of one of said vertical support panels.

6. A blank as in claim 3 in which each of said panels has a bottom edge and a top edge, in which each of said vertical support panels has at least one divider cut out of the material forming said vertical support panel and foldable outwardly and away from said vertical support panel for attachment to one of said side wall panels to form at least one divider in each of two receptacles when said blank is unfolded to form said carrier.

7. A blank as in claim 3 in which said bottom flanges include a relatively wide side flange extending from each of said vertical support panels, corner flanges extending from each of said first, third, fourth and sixth side wall panels, and relatively narrow side flanges extending from said second and fifth side wall panels.

8. A blank as in claim 3 in which the width of each of said wide side flanges is sufficient to cover the full width of one of said bottom structures, and each of said upper flanges has at least one projection adapted to be inserted into a slot to lock said upper flange in place when said carrier is formed, and at least one slot near the lower edge of each of said wide side panels to receive one of said projections.

9. A blank as in claim 6 in which each of said vertical support panels has two of said dividers so that said carrier has six compartments for holding beverage bottles or the like.

10. A blank as in claim 7 in which each of said corner flanges has a diagonal fold line forming an attachment tab for attaching said corner flange to an adjacent side flange, each of said corner flanges being folded over and folded along said diagonal fold line with adhesive on the exposed surface of the folded-over attachment tab.

11. A blank as in claim 4 in which each of said edge flanges is folded over with adhesive on the exposed surface of said edge flange.

12. A blank as in claim 6 in which each of said dividers has an end tab with adhesive on the exposed surface of said end tab.

13. A blank as in claim 5 in which one of the exposed surface of each of said handle reinforcement panels and the upper portion of one of said vertical support panels has adhesive on it, and each of said handle reinforcement panels is folded over onto and is adhered to one of said upper portions.

14. A blank as in claim 11 in which each of said first side wall panel and said third side wall panel has a leading edge, and in which the distance between said trailing edge of said first vertical support panel and the leading edge of said first side wall panel is equal to the distance from said leading edge of said first side wall panel and the leading edge of said third side wall panel, and said blank is folded along said leading edge of said first side wall panel with said first edge flange adhered to said third side wall panel adjacent said leading edge thereof.

15. A blank as in claim 14 in which each of said sixth and fourth side wall panels has a trailing edge, and in which the distance between said leading edge of said second vertical support panel and the trailing edge of said sixth side wall panel is equal to the distance between the latter edge and the trailing edge of said fourth side wall panel, and said blank is folded along said trailing edge of said sixth side wall panel with said second edge flange adhered to said fourth side wall panel adjacent the trailing edge thereof.

16. A blank as in claim 7 in which each of said corner flanges has a diagonal fold line forming an attachment tab having an exposed surface for attaching said corner flange to an adjacent side flange, each of said corner flanges being folded over and folded along said diagonal fold line with adhesive on the exposed surface of the folded-over attachment tab and each of said side flanges is folded over, and said side flanges are attached to said attachment tabs.

17. A blank as in claim 16 in which each of said vertical support panels has an exposed back surface and at least one of the exposed back surfaces of said vertical support panels has adhesive on it, and said vertical support panels are folded over onto one another and adhered together back-to-back.

18. A method of making a carrier from a sheet of material, said method comprising the steps of (a) creating a linear blank for said carrier, said blank having;

(1) a first vertical support panel having a leading edge and a trailing edge;

(2) first, second and third side wall panels foldably connected together in series, said first side wall panel being foldably connected to said leading edge of first vertical support panel;

(3) fourth, fifth and sixth side wall panels foldably connected together in series, said fourth side wall panel being foldably connected to said third side wall panel; and (4) a second vertical support panel having a leading edge and a trailing edge, said sixth side wall panel being foldably connected to said trailing edge of said second vertical support panel;

in which each of said groups includes three side wall panels, in which each of said side wall panels and said vertical support panels has a top edge and a bottom edge, and a flange extending from each of said bottom edges, said flanges being adapted to fit together when folded to form said bottom wall structure for each of said receptacles, in which the flanges extending from one of said side walls and one of said vertical support panels in each of said receptacles extends across said bottom wall structure, and two others of said flanges in each of said receptacles is a corner flange foldable along a diagonal line;

(b) bending said flanges and applying adhesive to selected areas of said blank to be adhered to other areas of said blank; and (c) folding said blank to cause said selected areas to adhere to said other areas of said blank.

19. A method as in claim 18 including the step of nesting a plurality of said linear patterns on said sheet, and separating each of said patterns from said sheet.

20. A method as in claim 18 including folding said corner flanges along said diagonal lines and applying adhesive to the exposed surface of each of said corner flanges.

21. A method as in claim 20 in which said selected areas to which said adhesive is applied include the back surface of one of said vertical support panels, flanges extending from the ends of said blank, and exposed end surfaces of dividers positioned to divide each of said receptacles into one of the group consisting of two and three compartments.

* * * * *